US006490847B2

(12) United States Patent
Serenita et al.

(10) Patent No.: US 6,490,847 B2
(45) **Date of Patent: *Dec. 10, 2002**

(54) CARTONS FOR PREPARING PARTY FAVORS

(75) Inventors: Charles I. Serenita, Perrinville, NJ (US); Carolle Desroches Ramey, New York, NY (US)

(73) Assignee: Blumental Lansing Company, Carlstadt, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/539,926

(22) Filed: Mar. 31, 2000

(65) Prior Publication Data

US 2002/0088733 A1 Jul. 11, 2002

(51) Int. Cl.[7] ..... B65B 49/00
(52) U.S. Cl. ..... 53/464; 53/414
(58) Field of Search ..... 206/485; 53/464, 53/453, 442, 414; 428/26

(56) References Cited

U.S. PATENT DOCUMENTS 2,062,276 A * 11/1936 Burton ..... 428/26
2,282,657 A * 5/1942 Kirchen ..... 428/26
2,944,295 A * 7/1960 Sloan ..... 53/453
4,825,624 A * 5/1989 Calcerano ..... 53/442
5,001,885 A * 3/1991 Borella ..... 53/464
D336,907 S * 6/1993 Hennenberg ..... D15/145
5,473,858 A * 12/1995 Hayes ..... 53/414

* cited by examiner

*Primary Examiner*—David T. Fidei
(74) *Attorney, Agent, or Firm*—Katten Muchin Zavis Rosenman

(57) ABSTRACT

The present invention relates to cartons and materials for cartons that may be used to prepare party favors to form a small, attractive, package with small gifts within. The physical process of making a party favor is facilitated by an easy-to-assemble carton for preparing party favors. In one embodiment, blank walls of material for preparing the cartons may be employed to prepare the party favor as well as a pushing element facilitating wrapping of a gift. The carton may, in one embodiment, have multiple polygonal wall portions formed from blank wall material such as for example, plastic or cardboard with possible openings through wall surfaces to define a carton cavity for assembling a gift. The carton cavity may have an optional pushing element to insert into wrapping to help fill a wrapper, carton openings, or be formed from a sheet of blank wall material to form the party favor. A tulle may be draped over a wall portion of the carton, for example, and into the cavity of the carton a well is formed with tulle or other wrapping material for inserting party favors within, and can be secured by tying.

14 Claims, 14 Drawing Sheets

700

CARTONS FOR PREPARING PARTY FAVORS

FIELD OF THE INVENTION

The present invention relates to cartons for preparing party favors, and carton blanks for preparing party favors.

BACKGROUND OF THE INVENTION

The present invention relates to cartons and materials for cartons that may be used to prepare party favors.

On holidays, at parties or other social gatherings, it is often desirable to give away token gifts, or favors, to departing guests. These favors may often take the form of a small, attractive, package with small gifts therein.

Unfortunately, the physical process of making these favors may be a long, arduous task, especially for social events with a large number of guests. Clumsy people may have great difficulty in preparing them. Accordingly, actually making the favors may detract from the overall mirth and enjoyment of the social event for the individual making the favors.

Moreover, it is also often desirable to ensure that the party favors are of uniform size and appearance. This too, however, can be a difficult task. Quite often, party favors may be unpleasing in appearance and this too may also detract from the otherwise overall mirthful, happy atmosphere of planning and preparing for a social event.

According, there exists a need for a better, accurate, cheaper, and fun way of preparing party favors, that one of little skill is capable of using.

SUMMARY OF THE INVENTION

The present invention provides a carton for preparing party favors. The present invention also provides blanks for preparing cartons which may be employed to prepare party favors.

In accordance with an embodiment of the present invention, a carton for preparing a party favor is provided. This carton has a first face wall portion and a second face wall portion having an opening and having at least one side wall portion. This side wall portion extends between and is attached to at least a portion of the first wall portion and is attached to at least a portion of the second wall portion so that the side wall portion defines an exterior wall surface and an interior wall surface. This interior wall surface defines a carton cavity. The carton also has a gap positioned at a position between the side wall portion and the second face wall portion.

In accordance with another embodiment of the present invention, a method for making a party favor is provided. This method includes inserting a tying means into a gap of a carton. This carton has a first face wall portion and a second face wall portion having an opening, and having at least one side wall portion which extends between and is attached to at least a portion of the first wall portion and at least a portion of the second bottom wall portion so that the side wall portion defines an exterior wall surface and an interior wall surface which defines a carton cavity, wherein the gap is positioned at a position between the side wall portion and the second face wall portion.

The method further includes draping a tulle over the second wall portion; inserting a portion of the tulle into the opening of the second wall portion and into the cavity thereby creating a well; inserting party favors into to the well; and tying the tying means around the tulle.

DETAILED DESCRIPTION OF THE INVENTION

Figure 1:
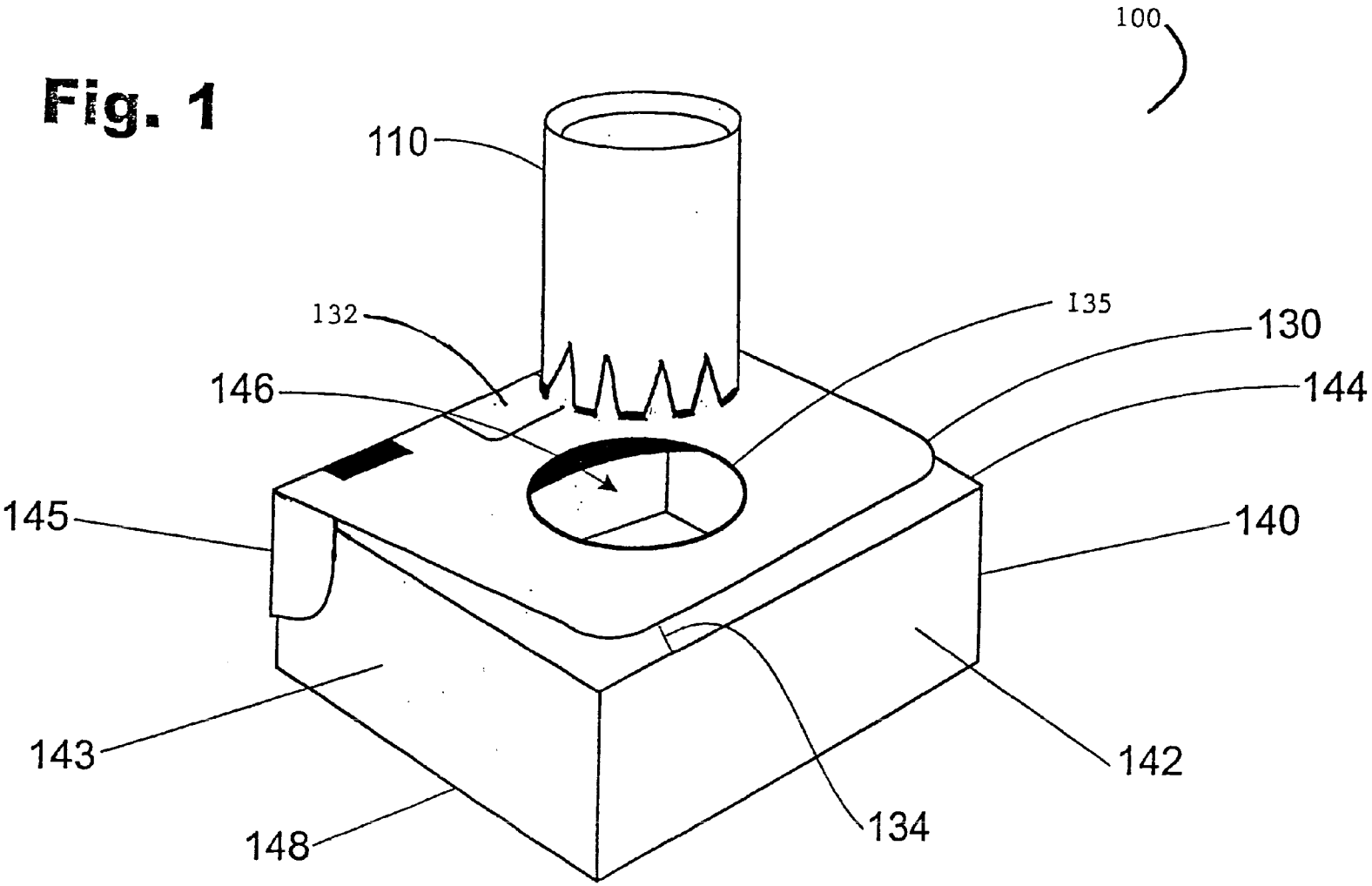
FIG. 1 is a perspective view of an embodiment of the present invention.

A party favor formed of blank wall material such as plastic or cardboard can be configured as a carton with polygonal wall portions.

Generally, the carton of the present invention includes a base (700) formed from a first face wall portion and a lid (500) formed from a second face wall portion and a base (700), the lid and base respectively having openings (430), (652), (650) the base (700) with one portion of the wall formed as a tab (660) which extends between and is attached to at least a portion of the lid (500), the lid (500) defining an exterior wall surface (1000) and the base having a wall surface (2000) which define a hollow carton entity through each respective (430), (652), (650) openings of the lid and base.

Figure 8:
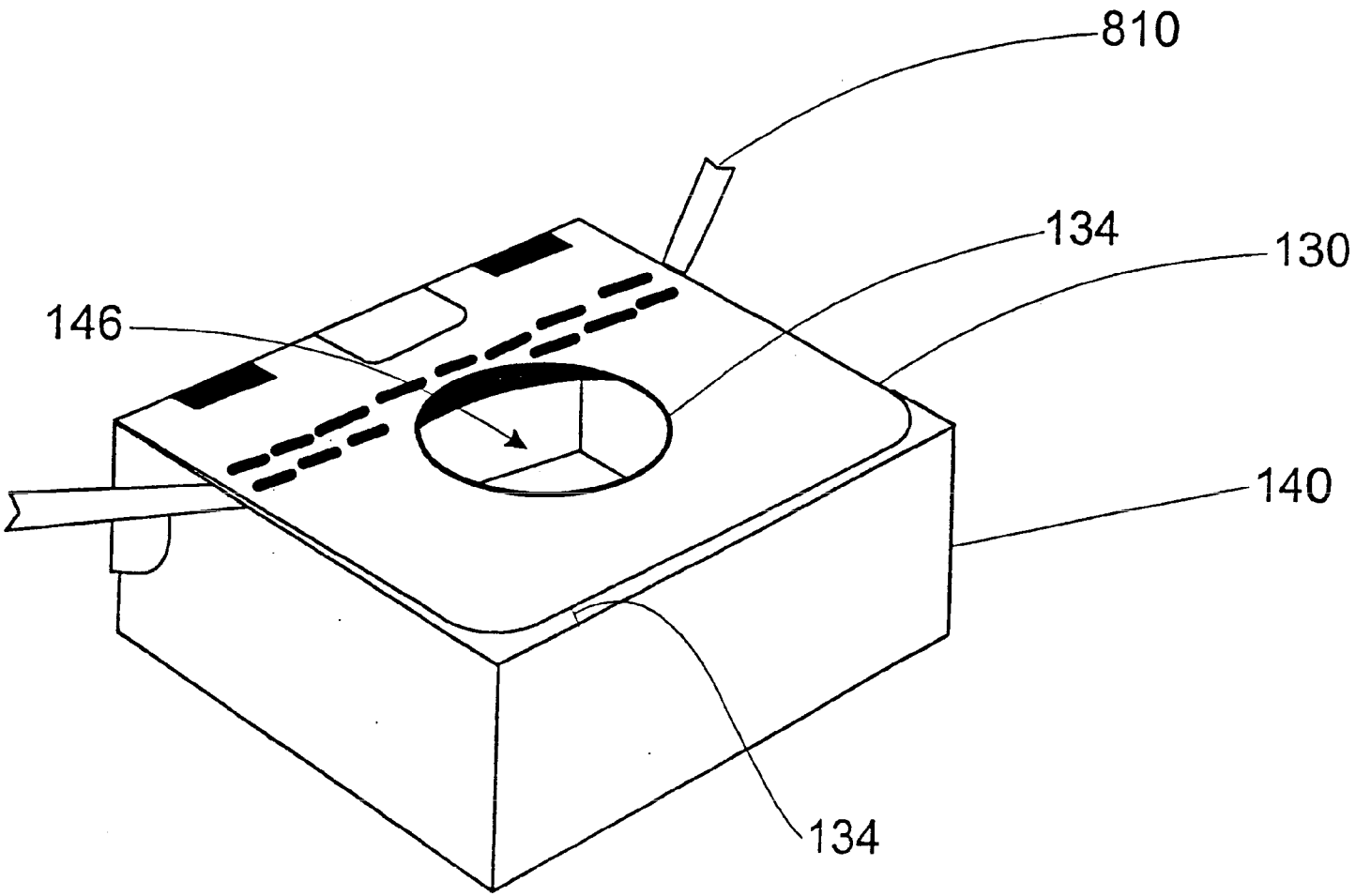
FIG. 8 is an illustration of a step in the forming of a party favor according to the present invention.

The lid (500) may be hingedly connected to (660) and detachable from the base (700). The carton may further include a "first face wall portion", the face wall portion (3000) having an opening (650) and formed from a side wall of blank (600) material to form a base (700) "which extends between and is attached (660) to (432) to form a carton with gap (134), FIG. 8.

The carton may further include a third face wall portion (3000) formed of blank (600) and may have an opening (650) which is attached to at least a portion of the sidewall portion which is positioned between the second face wall (lid) portion and the first face wall portion (base) such that each respective opening (430), (652), (650) overlap in final assembly of the party favor.

In general (500) the gap between a side wall portion of the base (700) and second face wall portion (lid) has a size sufficient for receiving a means for tying. The gap (134) may extend substantially about the second face wall portion (lid) and the sidewall portion of the base wall surface (2000).

The favor maker of the present invention may be configured in a variety of cross-sectional shapes, and such may be selected with a view to the product to be packaged therein. Preferably, the side wall portion is rectilinear in cross-section, e.g., triangular, rectangular, square or polygonal, but it may also be circular or oval.

The favor maker may be constructed from blanks made from various packaging materials which can be cut, creased or folded. The blanks are sufficiently rigid to be self-supporting when folded into a carton having a geometrical cross-section. Various composite and noncomposite foldable materials may thus be used, and such include cardboards, e.g., claycoated or non-coated chipboard and aluminum or alloy. Plastic materials, such as acetate or polyvinylchloride, may also be used. Corrugated cardboards, such as E Flute, and microfluted boards, such as MICROFLUTE, may also be used. The carton may also be constructed from recycled cardboard. The favor maker of the present invention may conveniently be formed from a one-piece blank.

Although it is possible to manufacture the carton of the invention in a variety of ways, it is preferred that it be made from a carton blank which comprises a single sheet of foldable material. The blank sheet may be provided with preformed creases which, upon folding, define longitudinally extending parallel corner edges of the favor maker. Moreover, the blank is preferably a thickness of 0.22–0.24 point, but virtually any commonly used thickness is acceptable.

Referring now to the drawings in detail, and initially to FIG. 1, an overview of the preferred embodiment in accordance with the present invention is depicted. As illustrated in FIG. 1, favor maker 100 generally comprises three units; a pusher 110, a lid 130, and abase 140.

As shown, the pusher 110 is generally cylindrical in shape; it may, however, also be octagonal, rectangular, funnel shaped or virtually any other shape. Any shape that is of sufficient dimensions to fit into cutout 135 and which is capable of receiving the desired party favors is acceptable. Pusher 110 also has a hollowed out center of sufficient size to allow desired party favors to be passed from one end through to the other.

Lid 130 is hingedly attached to base 140 by flap 132, creating gap 134 between the base 140 and 130. As shown, lid 130 is generally rectangular in shape; however, it may be any shape and of sufficient dimension to approximately cover the top of base 140. As shown, lid 130 also has a cut-out of a generally circular shape located approximately in the center of its surface. This cut-out, however, may be any shape, location or size suitable for receiving pusher 110. The bottom portion 148 of base 140 may also have a similar cut-out; however, this cut-out is optional.

Base 140 has four sidewall portions 142, 143, 144, and 145 that extend longitudinally from opposed ends and which circumscribe and define an interior having a generally rectangular cross section. As shown, base 140 also has a cut-out 146, which is of a generally circular shape located approximately in the center of its top surface. This cut-out, however, may be any shape, location or size suitable for receiving pusher 110.

Figure 2:
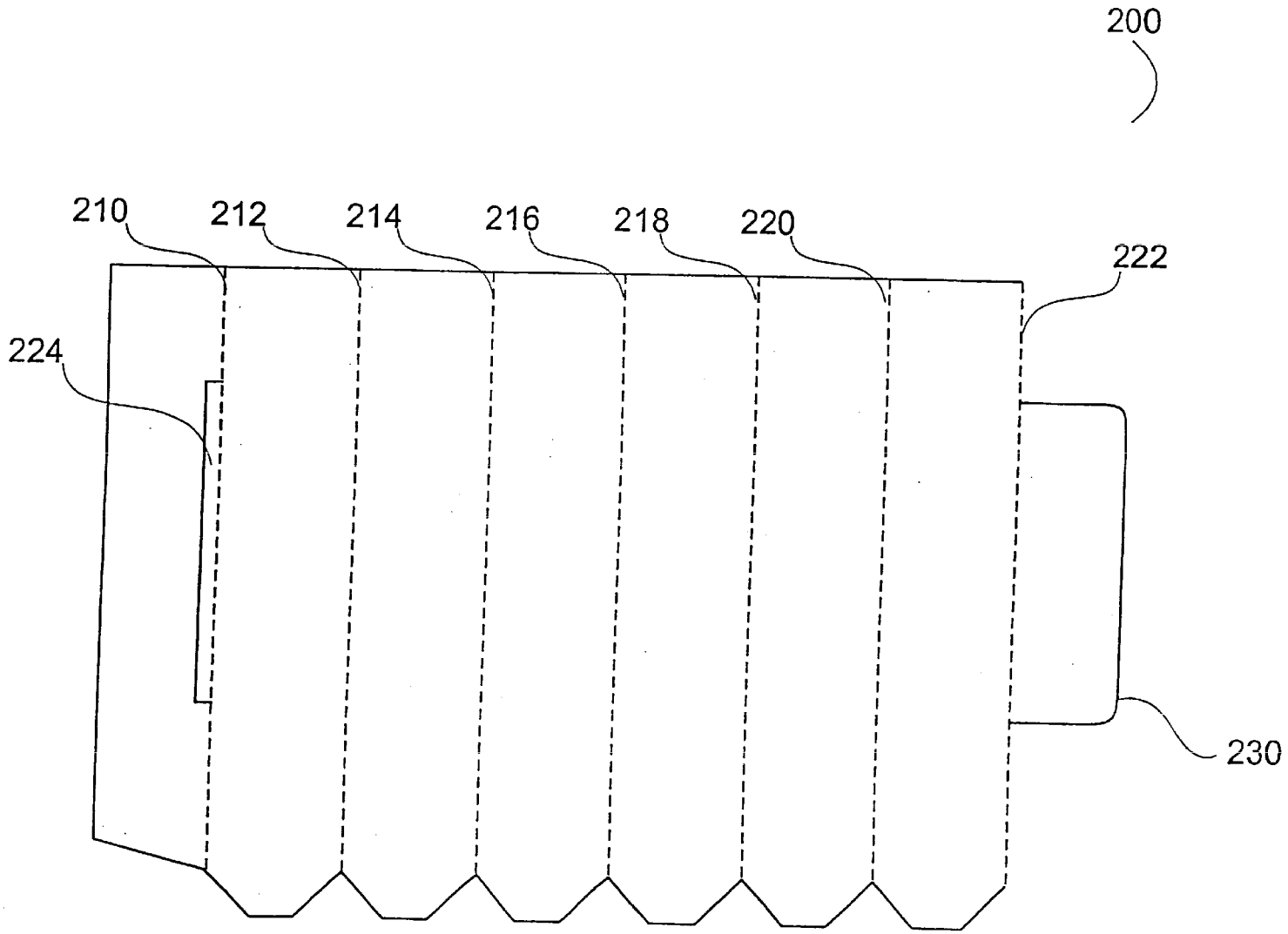
FIG. 2 is a plan view of a blank for forming a pusher according to an embodiment of the invention.
Figure 4:
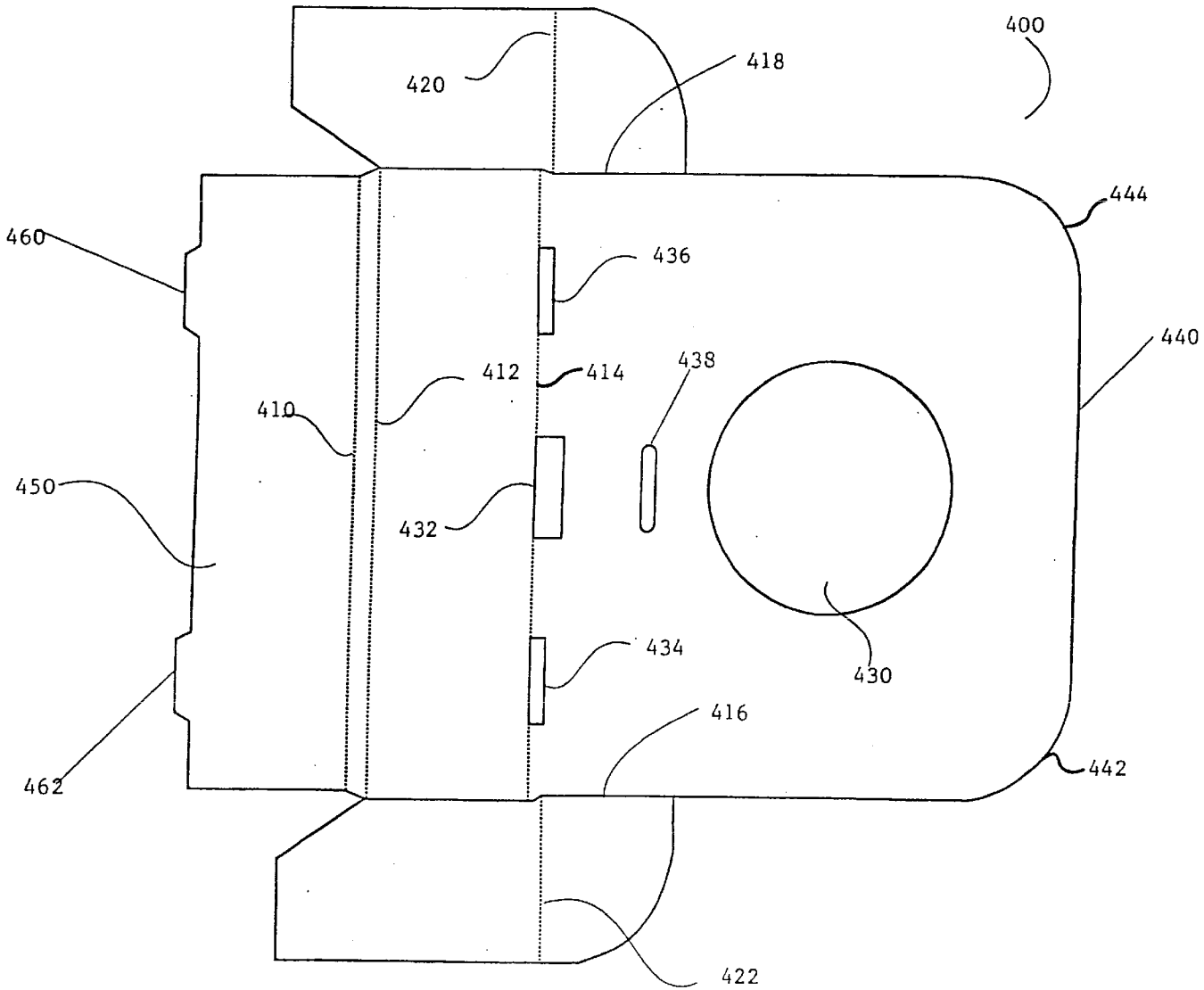
FIG. 4 is a plan view of a blank for forming a lid according to an embodiment of the invention.
Figure 6:
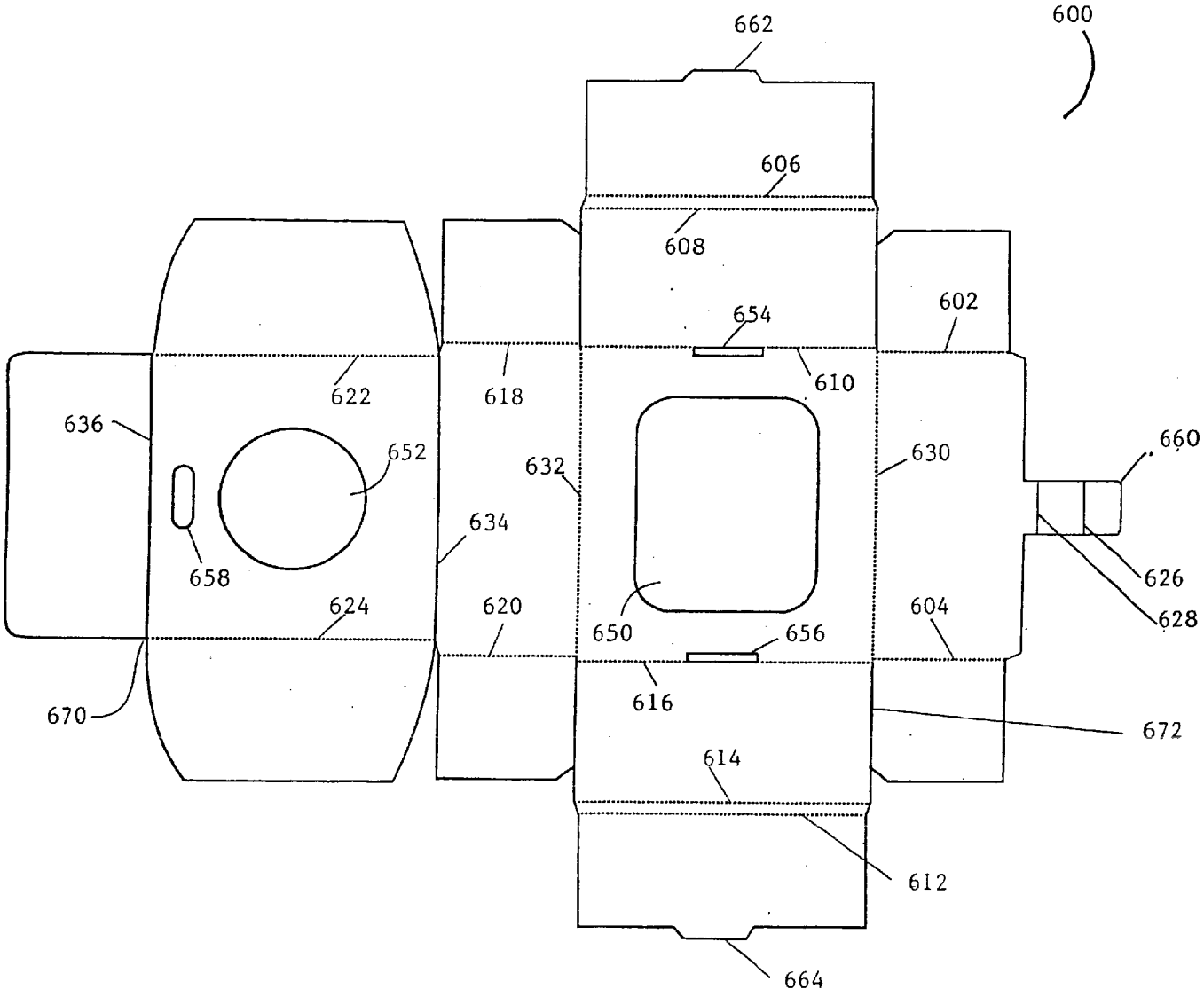
FIG. 6 is plan view of a blank for forming a base according to an embodiment of the invention.

FIGS. 2, 4, and 6 each illustrate blanks that can be folded to construct the favor maker of the present invention. FIG. 2 illustrates a blank that can be folded to make the pusher 110 of FIG. 1. FIG. 4 illustrates a blank that can be folded to make the lid 130 of FIG. 1, and FIG. 6 illustrates a blank that can be folded to make the base 140 of FIG. 1.

Figure 3:
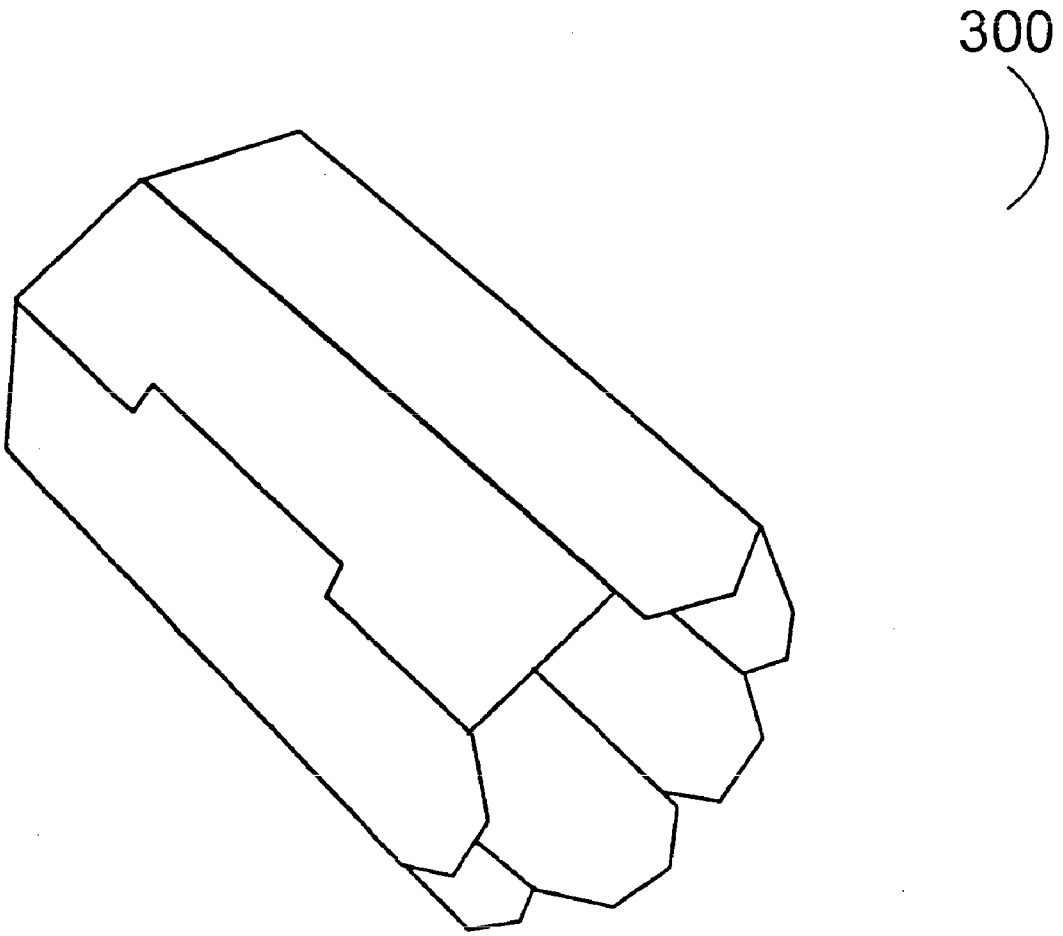
FIG. 3 is a perspective view of the pusher according to an embodiment of the invention.

The blank illustrated in FIG. 2 comprises a foldable sheet of material 200 having parallel, longitudinal crease lines, 210, 212, 214, 216, 218, 220, 222, slit 224, and tab 230. Upon folding the material 200 along parallel, longitudinal crease lines 210, 212, 214, 216, 218, 220, 222, and passing tab 230 into slit 224, a pusher 110 is thereby constructed will circumscribe a generally cylindrical shape. The constructed pusher is illustrated in perspective view in FIG. 3.

Figure 5:
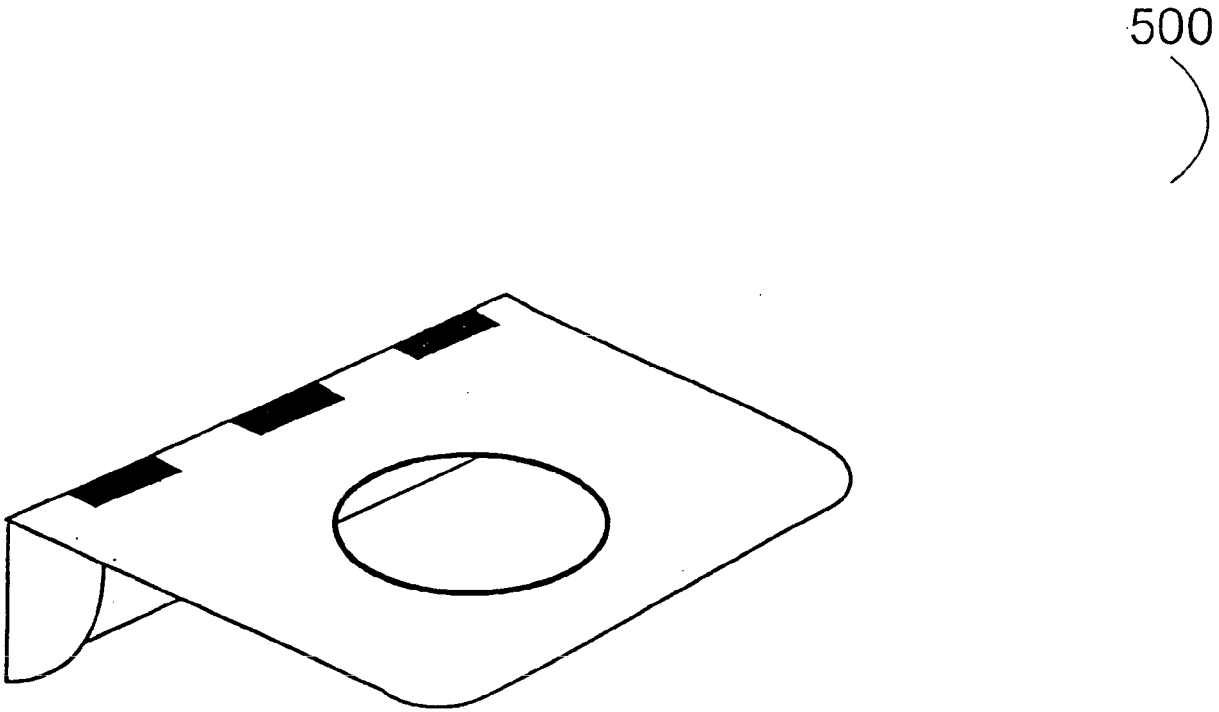
FIG. 5 is a perspective view of the lid according to an embodiment of the invention.
Figure 7:
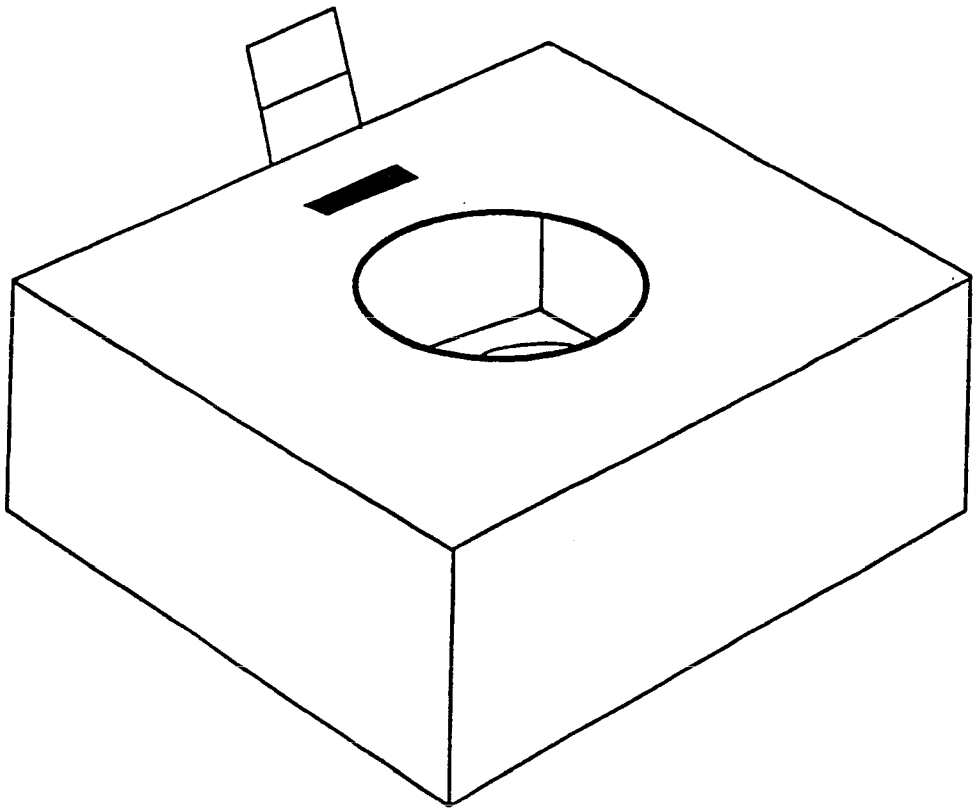
FIG. 7 is a perspective view of the base according to an embodiment of the invention.

The blank illustrate in FIG. 4 comprises a foldable sheet of material 400 having parallel, longitudinal crease lines 410, 412, 414, 420, 422 and parallel, lateral crease lines 416, 418. The blank illustrated in FIG. 4 further comprises a generally circular shaped cutout 430 situated approximately in the center of front portion 440. Preferably, the corners 442, 444 of front portion 440 are rounded, however, square shaped corners or any other suitable shape are also acceptable. Also provided are cut-outs 432, 434, 436, 438, and tabs 460, 462. In order to form the lid 130 of FIG. 1, blank 4300 is folded along parallel, longitudinal crease lines 420, 422, and then parallel, lateral crease lines 416, 418. Next, parallel, longitudinal crease lines 414, 412, and 410 are folded, and tabs 460, 462 are fit into cut-outs 436, 434, respectively. Upon completion of this, the lid as depicted in perspective view in FIG. 5 is constructed The blank illustrated in FIG. 6 comprises a foldable sheet of material 600 having parallel longitudinal crease lines 602, 604, 606, 608, 610, 612, 614, 616, 618, 620, 622, 624, and parallel lateral crease lines 626, 628, 630, 632, 634, 636. The blank illustrated in FIG. 6 further comprises cut-outs 650, 654, 656, 652, 658. Cut-out 652 is a generally circular shape cut-out, situated approximately in the center of top portion 670. Cut-out 650 is a generally rectangular shape cut-out with rounded edges located approximately in the center of bottom section 672. Also provided are tabs 660, 662, 664. In order to form the base 140 of FIG. 1 blank 600 is folded along its parallel longitudinal crease lines 602, 604, 618, and 620 and then longitudinal crease lines 630 and 632. Longitudinal crease lines 606, 608, 610, 612, 614, and 616 are then folded and tabs 662, 664 were fit into cut-outs 654, 656 respectively. The blank is then folded along longitudinal crease lines 622, 624, lateral crease line 636 and then lateral crease line 634. Once this is completed, the base 700 as illustrated in perspective view in FIG. 7 is constructed.

Figure 14:
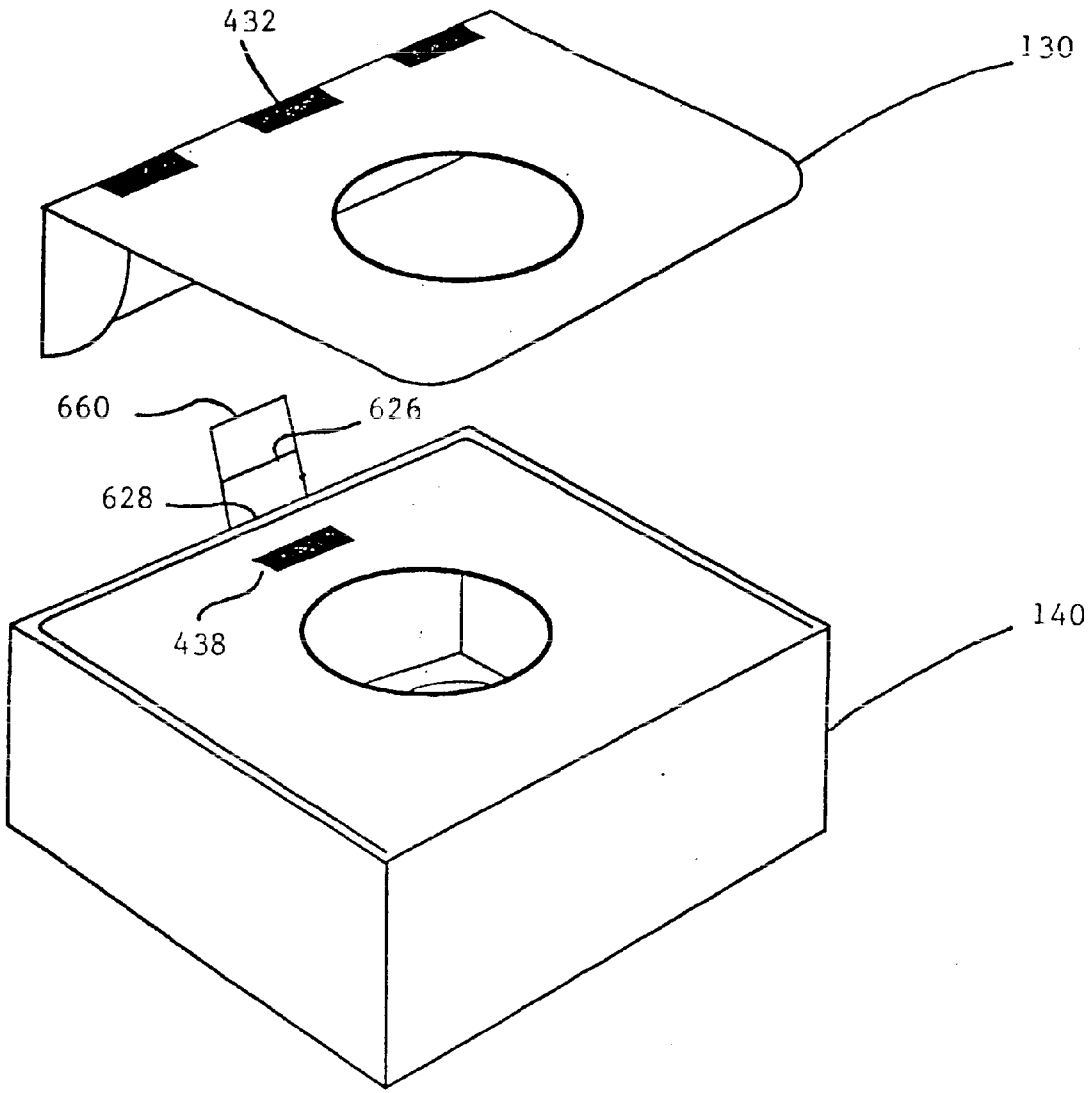
FIG. 14 is a perspective view of the base and lid according to an embodiment of the invention.

Next, in order to assemble the properly constructed portions, lid 130 is slid onto base 140, as shown in FIG. 14. Tab 460 is slid into cut-out 432. Lid 130 is then locked into place by creasing tab 660 along crease lines 626, 628, and inserting the tab 660 into cut-out 438.

Figure 9:
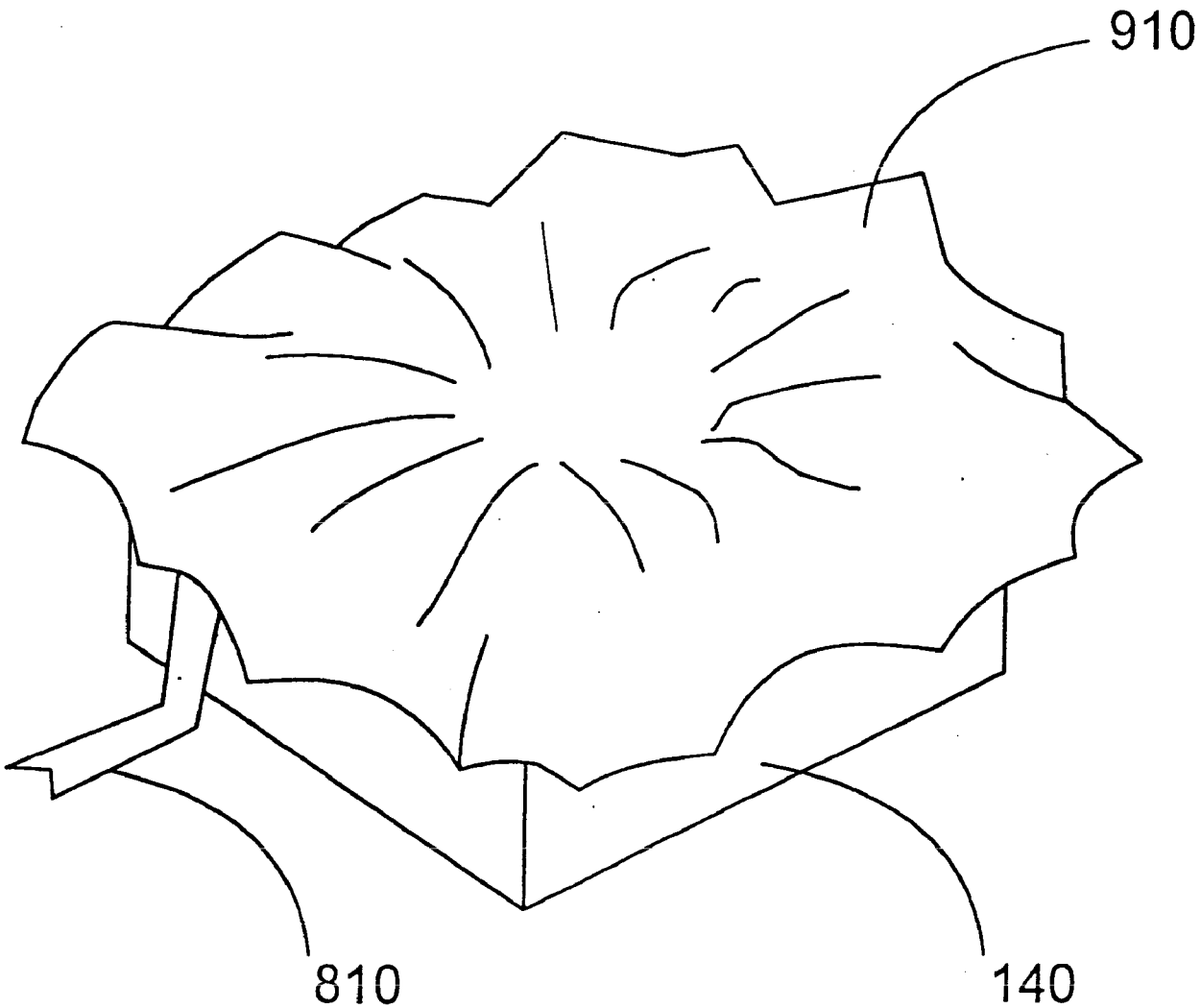
FIG. 9 is an illustration of a step in the forming of a party favor according to the present invention.
Figure 10:
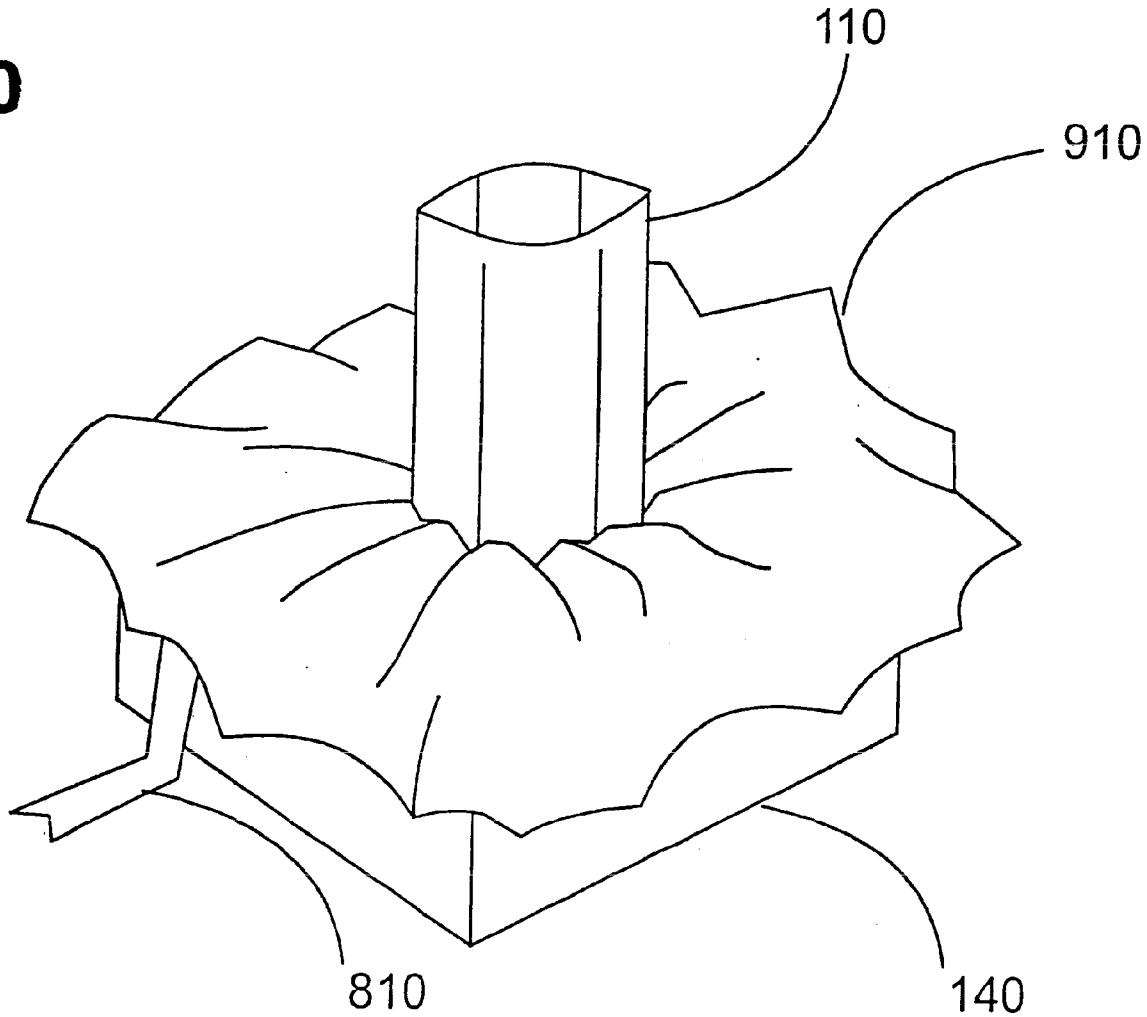
FIG. 10 is an illustration of a step in the forming of a party favor according to the present invention.
Figure 11:
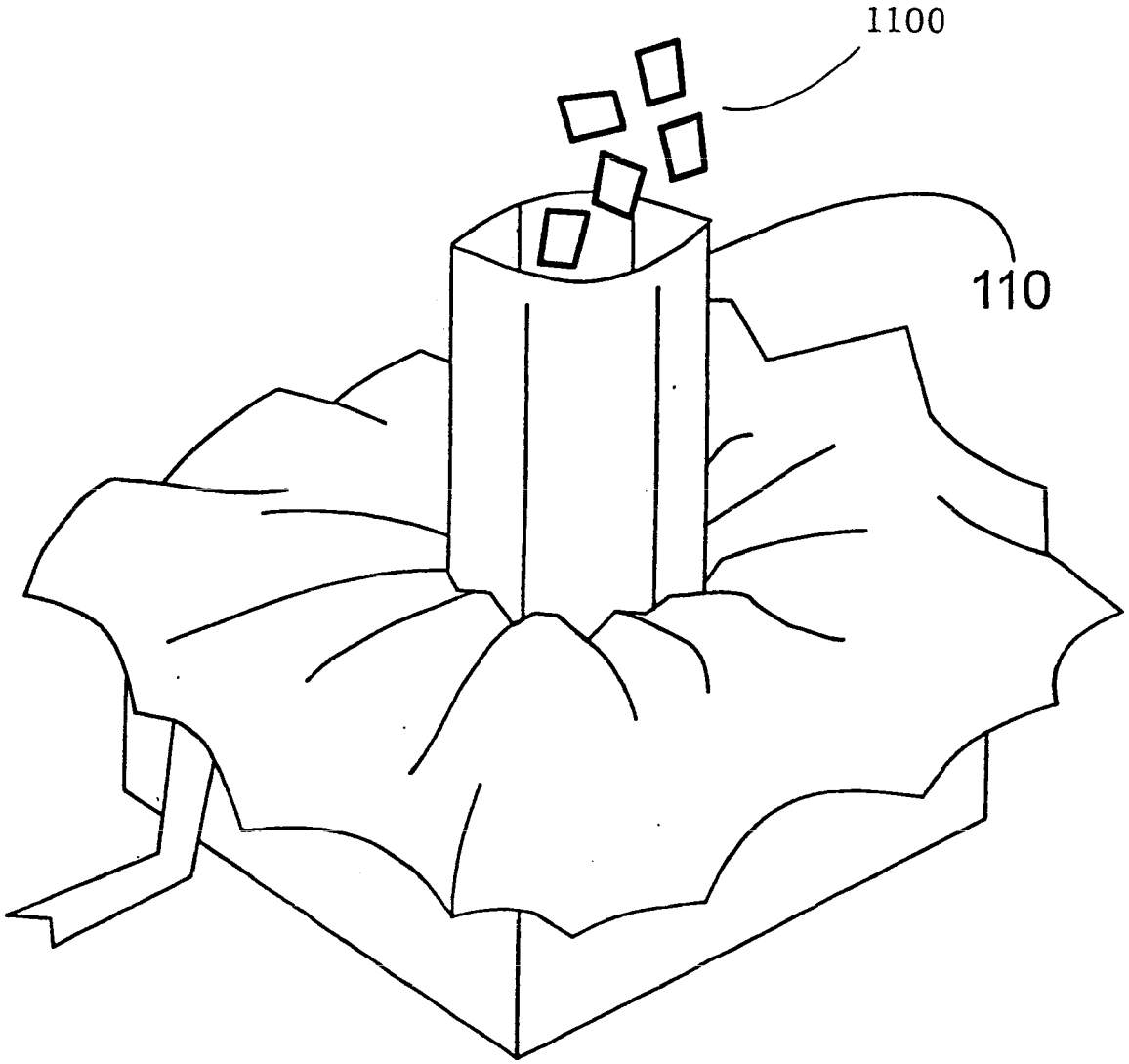
FIG. 11 is an illustration of a step in the forming of a party favor according to the present invention.
Figure 12:
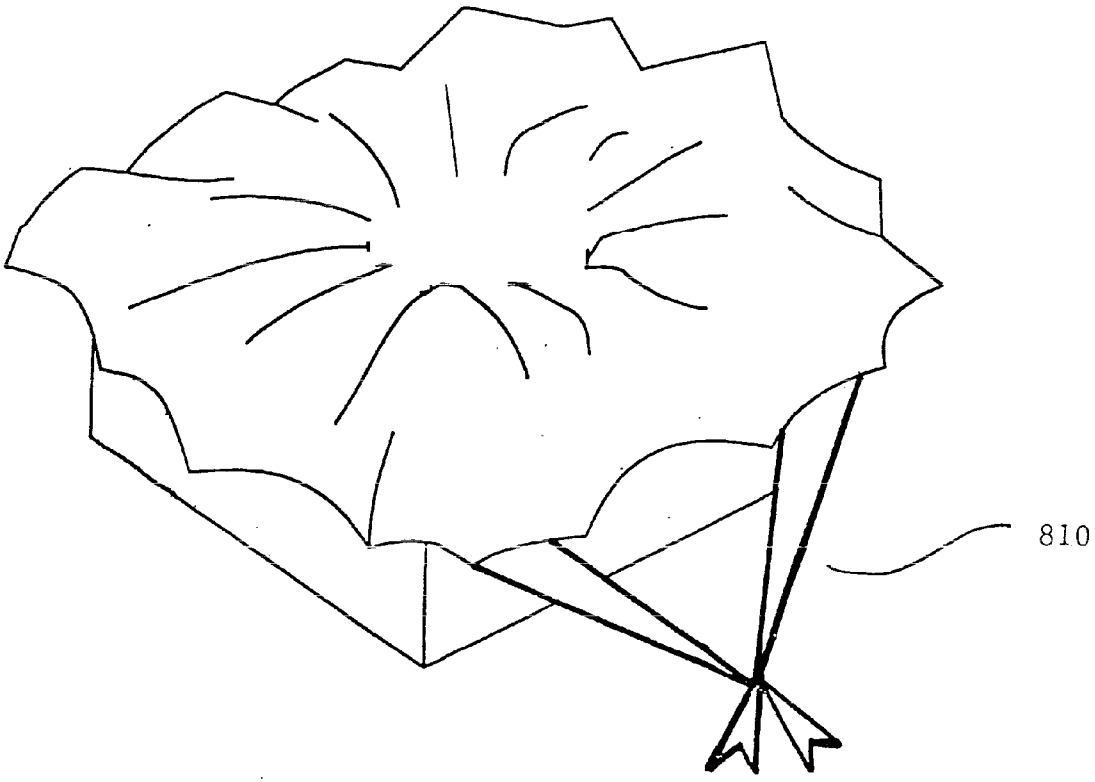
FIG. 12 is an illustration of a step in the forming of a party favor according to the present invention.
Figure 13:
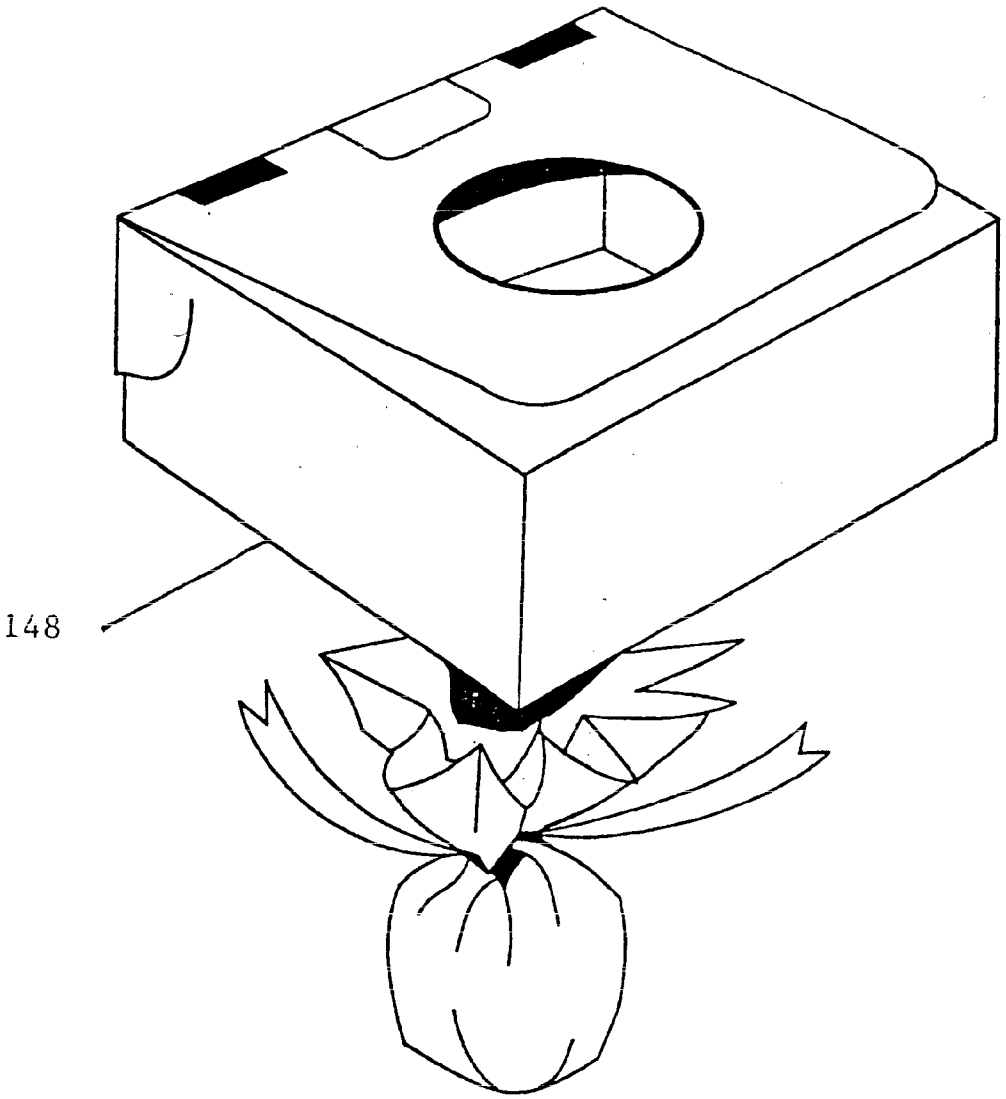
FIG. 13 is an illustration of a step in the forming of a party favor according to the present invention.

In order to make a party favor using the properly constructed favor maker as described above, as shown in FIG. 8, a ribbon, or any other suitable tying material, such as a string or cord, is slid in gap 134, between lid 130 and base 140. Next, as shown in FIG. 9, a tulle 910 is draped over lid 130 and base 140, covering the cut-out 135 of lid 130, and cut-out 146 of base 140. Tulle 910 may be any suitably flexible material for containing party favors, such as tissue paper, wrapping paper, lace, fabric or tin foil. Next, as shown in FIG. 10, pusher 110 is pushed into cut-outs 135 and 146 to create a well within base 140. Next, as shown in FIG. 11, party favors 1100 are allowed to fall into the created well through the pusher 110. Next, as shown in FIG. 12, pusher 110 is removed, and ribbon 810 is drawn out and tied into a knot. Lastly, as shown in FIG. 13, the completed party favor is allowed to fall through bottom opening 148.

While the invention has been described in respective to the above embodiment of the invention, it should be understood that the invention is not limited to these precise embodiments. Rather, many modifications and variations would present themselves to person's skills in the art for that departure from scope and spare of the inventions which is defined in the pending claims.

We claim:

1. A carton for preparing a party favor formed from a blank wall material, said carton comprising:

a first face wall portion configured to form a base;

a second face wall portion to form a lid having an opening and having at least one side wall portion to form a tab of first face wall portion which extends between and is attached to at least a portion of the first wall portion base and is attached to at least a portion of the second wall portion lid so that the side wall portion tab and said lid defines an exterior wall surface and an interior wall surface which defines a carton cavity, and having a gap positioned at a position between the first face wall portion connected to the second face wall portion forming said lid; and a pushing means.

2. A carton according to claim 1 wherein the second face wall portion lid is hingedly connected to the side wall portion of said first face wall portion.

3. A carton according to claim 1 further comprising a face wall portion of said base having an opening and which extends between and is attached to at least a portion of the side wall portion and which is positioned between the second face wall portion lid and the first face wall portion base.

4. A carton according to claim 3 wherein the gap has a size sufficient for receiving a means for tying.

5. A carton according to claim 1 wherein the first face wall portion base has an opening.

6. A carton according to claim 3 wherein the first face wall portion base has an opening.

7. A carton according to claim 6 wherein the openings in each of the face wall portions substantially overlap.

8. A carton according to claim 7 further comprising said pushing means positioned at a position within the openings of the second face wall portion lid and third face wall portion of said base.

9. A carton according to claim 7 wherein the side wall portion is a polygonal side wall portion.

10. A carton according to claim 7 wherein the side wall portion is a rectangular side wall portion.

11. A carton according to claim 9 wherein the carton is constructed from cardboard.

12. A carton according to claim 1 wherein the carton is constructed from a one piece blank.

13. A method for making a party favor comprising:

inserting a tying means into a gap of a carton having a first face wall portion configured to form a base and a second face wall portion lid having an opening, and having at least one side wall portion tab which extends between and is attached to at least a portion of the first wall portion base and at least a portion of the second bottom wall portion lid so that the portions define a carton with a cavity, wherein the gap is positioned at a position between said wall portions and the second face wall portion lid;

draping a tulle over the second wall portion lid;

inserting a portion of the tulle into the opening of the second wall portion lid and into cavity thereby creating a well;

inserting party favors into to the well; and tying the tying means around the tulle.

14. A method according to claim 13 further comprising dropping the tulle through an opening in the first face wall base.

* * * * *